US005226781A

United States Patent [19]

Glachet et al.

[11] Patent Number: 5,226,781

[45] Date of Patent: Jul. 13, 1993

[54] PROCESS AND INSTALLATION FOR TRANSFERRING PRODUCTS FROM A CONTAMINATED ENCLOSURE INTO A SECOND ENCLOSURE WITHOUT CONTAMINATING THE LATTER

[75] Inventors: Charles Glachet; Liliane Ponchet, both of Vendome, France

[73] Assignee: Euritech, Vendome, France

[21] Appl. No.: 853,139

[22] Filed: Mar. 18, 1992

[30] Foreign Application Priority Data

Mar. 20, 1991 [FR] France ..... 91 03390

[51] Int. Cl.[5] ..... B65D 51/18

[52] U.S. Cl. ..... 414/217; 414/146; 414/221; 414/292; 376/272

[58] Field of Search ..... 414/146, 217, 221, 292, 414/411; 376/203, 205, 206, 260, 272

[56] References Cited

U.S. PATENT DOCUMENTS

| | | | |
|---|---|---|---|
| 4,260,312 | 4/1981 | Hackney | 414/292 |
| 4,390,040 | 6/1983 | Beyen | 414/292 X |
| 4,534,389 | 8/1985 | Tullis | 414/217 X |
| 4,619,572 | 10/1986 | Lorenzelli et al. | 414/217 |
| 4,676,712 | 6/1987 | Hayward et al. | 414/411 |
| 4,754,894 | 7/1988 | Simon et al. | 376/272 X |
| 4,755,347 | 7/1988 | Tolmie | 414/146 X |
| 4,847,009 | 7/1989 | Madle et al. | 376/272 X |
| 4,897,963 | 2/1990 | Reboul et al. | 414/411 X |
| 4,962,726 | 10/1990 | Matsushita et al. | 414/217 X |
| 4,975,240 | 12/1990 | Lahr et al. | 414/411 X |

FOREIGN PATENT DOCUMENTS

| | | | |
|---|---|---|---|
| 0187557 | 7/1986 | European Pat. Off. . | |
| 0187558 | 7/1986 | European Pat. Off. . | |
| 2313747 | 12/1976 | France . | |
| 2633254 | 12/1989 | France . | |
| 0148999 | 11/1979 | Japan | 414/146 |
| 472611 | 6/1969 | Switzerland . | |

*Primary Examiner*—Michael S. Huppert
*Assistant Examiner*—James Keenan
*Attorney, Agent, or Firm*—Pearne, Gordon, McCoy & Granger

[57] ABSTRACT

For transferring products from a contaminated enclosure (12) into a second enclosure (16) without contaminating the latter, it is proposed to engage on the contaminated enclosure a transportation container (20), in which is placed an empty transfer chamber (22). After removing the coupled doors (C,F,H) of the contaminated enclosure, the container and the transfer chamber, the products to be transferred are introduced into the latter, without the space surrounding the chamber within the container communicating with the enclosure. This is followed by the reclosing of the coupled doors (C,F,H) and the disconnection of the container (20), in order to transport it and engage it on the second enclosure (16). The coupled doors (B'C', F) of said second enclosure and the container (20) are then opened in order to introduce into said second enclosure the transfer chamber (22) containing the products.

6 Claims, 5 Drawing Sheets

10
12
14
16
18
20
22
A
A'
B
B'C'
C
D
E
F
G
H

32'
B'C'
16
40'
E
F
94
34'
100
36'
A'
50'
H
D
130
132
120
H
112
20
22
14
126
128

PROCESS AND INSTALLATION FOR TRANSFERRING PRODUCTS FROM A CONTAMINATED ENCLOSURE INTO A SECOND ENCLOSURE WITHOUT CONTAMINATING THE LATTER

BACKGROUND OF THE INVENTION

The invention relates to a process and an installation for transferring products such as waste from a contaminated enclosure into a relatively clean second enclosure, without said transfer bringing about the contamination of the second enclosure. The invention more particularly applies to the nuclear industry, but can also be used in the chemical industry.

Throughout the text the word "product" must be understood in the broadest possible sense and can apply both to loose products in various forms (solids, liquids, powders, etc.) and to objects of any nature.

Conventionally, when it is wished to introduce a product into or extract it from a tight enclosure, use is made of a transportation container, which is engaged on the enclosure by means of a double door transfer device. This well known device makes it possible to successively engage the container on the enclosure, link the container with the enclosure by the opening of a double door to ensure the transfer of the products, the closing of said link by putting back into place the double door and then separating the transportation container, without at any time the surfaces having to come into contact with the external atmosphere being contaminated.

However, when such an installation is used for transferring a product between two enclosures, the contaminated atmosphere of the first enclosure penetrates the container when the latter is linked with the enclosure to receive the product to be transferred. Consequently, when the same container is subsequently connected to a second enclosure for receiving the product, the opening of the double door necessary for introducing the product into the second enclosure has the effect of introducing the contaminated atmosphere in the container into the second enclosure. It is consequently not possible when such an installation is used, to maintain the second enclosure free from the contamination present in the first enclosure.

SUMMARY OF THE INVENTION

The invention specifically relates to a process and an installation, whose original design makes it possible to transfer products from a contaminated enclosure into a second relatively clean enclosure compared with the contaminated enclosure, without contaminating said second enclosure.

According to the invention, this result is achieved by means of a process for transferring products from a contaminated enclosure into a second enclosure, without contaminating the latter, characterized in that it comprises:

respectively engaging on a flange, an adaptor and a door constituting an access system to the contaminated enclosure, a flange, an adaptor and a door constituting the access system to a transportation container, in which is placed an empty transfer chamber, whereof a flange and a door constituting an access system to said transfer chamber respectively bear on the adaptor and on the door of the transportation container;

extracting the three coupled doors in the contaminated enclosure for linking the transfer chamber with the latter;

introducing into the transfer chamber the product to be transferred;

reclosing the three coupled doors;

respectively disconnecting the flange, the adaptor and the door of the transportation container from the flange, the adaptor and the door of the contaminated enclosure;

transporting the transportation container in which is placed the transfer chamber containing the products to be transferred up to the second enclosure;

respectively engaging on a flange and a door constituting an access system to said second enclosure the flange and adaptor of the transportation container;

extracting in the second enclosure an assembly formed by the door of the second enclosure and the adaptor and door of the transportation container, in order to link said second enclosure with the latter;

introducing the transfer chamber containing the product to be transferred into the second enclosure;

putting back into place the said assembly; and respectively disconnecting the flange and adaptor of the transportation container from the flange and door of the second enclosure.

While using a tight, triple door transfer system, this process makes it possible to introduce the products to be transferred into a transfer chamber, whose interior is contaminated, transport the chamber to the second enclosure within a transportation container, which is never linked with the first enclosure and then introduce the transfer chamber containing the products into the second enclosure. During these different operations, the seal of the two enclosures with respect to the external atmosphere is preserved, as is the seal of the transportation container with respect to the external atmosphere and more particularly the contaminated atmosphere present in the first enclosure and in the transfer chamber is never in contact with the atmosphere present in the transportation container.

The invention also relates to an installation for transferring products from a contaminated enclosure into a second enclosure without contaminating the latter, characterized in that it comprises:

an access system to the contaminated enclosure, comprising a first flange, a first adaptor and a first door, first disconnectable linking means for maintaining the first adaptor in tight manner in an opening of the first flange, second disconnectable linking means for maintaining the first door in tight manner in an opening of the first adaptor and first engagement means provided on an outer face of the first flange, the first adaptor and the first door;

an access system to the second enclosure comprising a second flange and a second door, third disconnectable linking means for maintaining the second door in tight manner in an opening of the second flange and second engagement means provided on an outer face of the second flange and the second door;

a transportation container;

a transfer chamber which can be received in the transportation container;

an access system to the transportation container comprising a third flange, a second adaptor and a third door, fourth disconnectable linking means for maintaining the second adaptor in tight manner in an opening of the third flange, fifth disconnectable linking means for maintaining the third door in an opening of the second adaptor, third engagement means provided on an outer face of the third flange, the second adaptor and the third door and able to cooperate with the first engagement means and with the second engagement means and fourth engagement means provided on an inner face of the third door;

an access system to the transfer chamber comprising a fourth flange and a fourth door, sixth disconnectable linking means for maintaining the fourth door in tight manner in an opening of the fourth flange and fifth engagement means provided on an outer face of the fourth door and able to cooperate with the fourth engagement means; and application means for keeping the fourth flange bearing tightly against the second adaptor, when the transfer chamber is placed in the transportation container.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENT

Figures 1A, 1B, 1C, 1D, 1E, 1F:
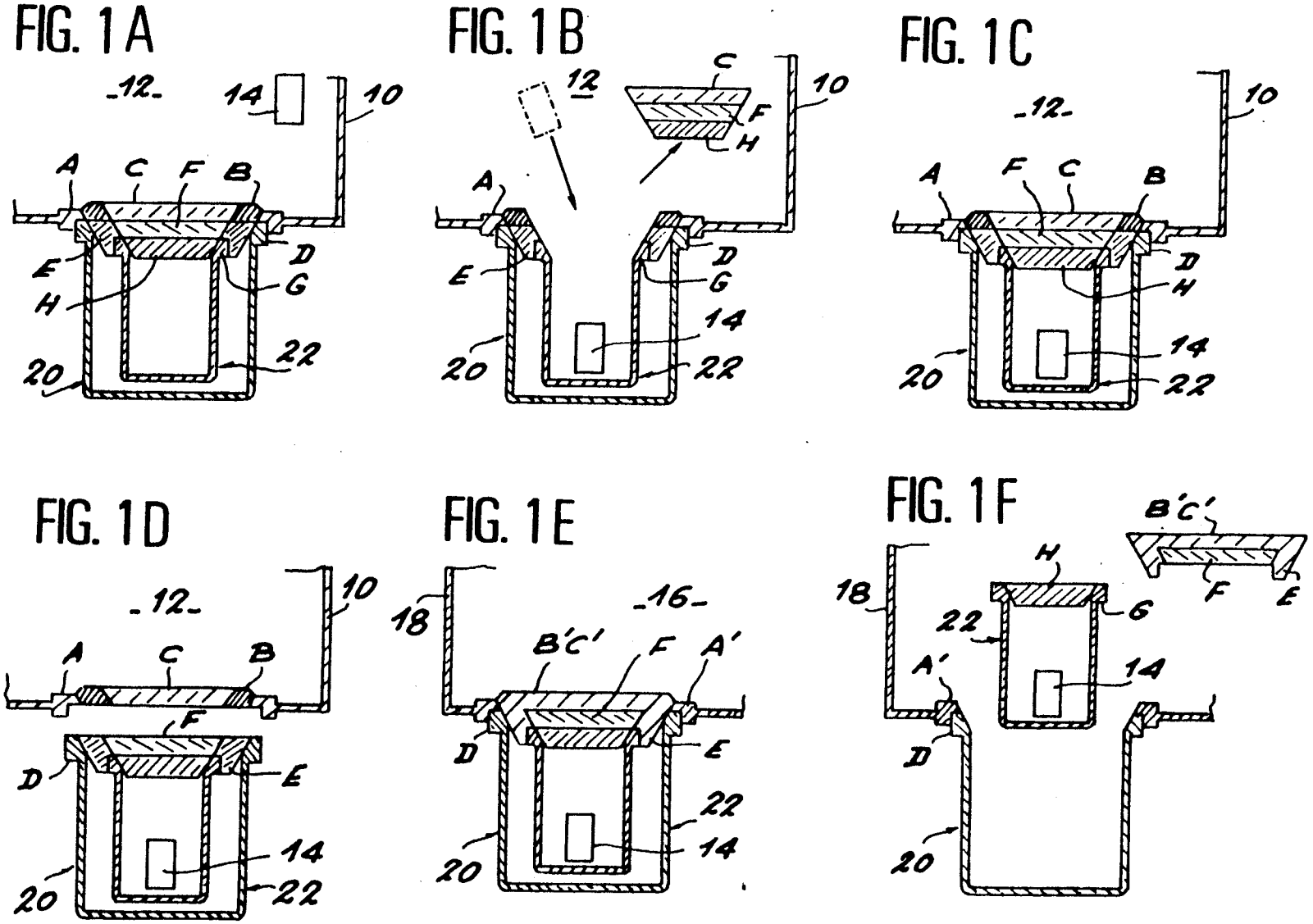
FIGS. 1A to 1F diagrammatically the main phases of performing the process according to the invention.

In FIGS. 1A to 1D, reference 10 designates part of the wall of a highly contaminated enclosure 12 housing products such as waste 14, which it is wished to transfer into a second relatively clean enclosure 16, whereof part of the wall is illustrated at 18 in FIGS. 1E and 1F. Although the thickness of the walls 10 and 18 of the cells 12 and 16 is illustrated in the same way in FIGS. 1A to 1F, the wall 10 is in reality a thick wall comprising all the $\alpha$, $\beta$ and $\gamma$ protections imposed by the high contamination present in the cell 12, whereas wall 18 is thinner and essentially ensures $\gamma$ protection.

The wall 10 of the contaminated enclosure 12 has at least one access system formed by a flange A, in which is normally tightly received an annular adaptor B, normally tightly sealed by a door C. The openings formed in the flange A and in the adaptor B are coaxial.

As is illustrated by FIG. 1A, onto the access system to the contaminated enclosure 12 constituted by the flange A, the adaptor B and the door C, can be engaged the complementary access system of a transportation container 20. This complementary access system also has a flange D, in which is tightly received an annular adaptor E, normally tightly sealed by a door F. The openings formed in the flange D and in the adaptor E are coaxial and their mean diameters are smaller than those of the openings formed in the flange A and in the adaptor B.

As will be shown in greater detail hereinafter, the engagement of the access system to the transportation container 20 on the access system to the contaminated enclosure 12 has the effect of connecting the flanges A and D and the adaptors B and E respectively, while freeing the adaptor E from the flange D and the door F from the adaptor E.

Within the transportation container 20 has previously been placed an empty transfer chamber 22, which also has an access system formed by a flange G, in which is normally tightly received a door H. The mean diameter of the opening formed in the flange G is less than that of the opening formed in the adaptor E. When the transportation container 20 is engaged on the access system to the contaminated enclosure 12, the door H is normally locked on the flange G of the transfer chamber 22 and engagement means provided between the doors F and H are freed.

The actuation from the interior of the contaminated enclosure 12 of a manipulating system carried by the door C makes it possible to connect the doors C and F, connect the doors F and H and free the door H from the flange G.

When these different operations are ended and as illustrated in FIG. 1B, the three doors C, H and B, which are then connected to one another for forming a triple door, are extracted in the interior of the contaminated enclosure 12 by an actuation of the linking means, which normally maintain the door C in tight manner in the adaptor B. Under these conditions, the contaminated enclosure 12 is linked with the interior of the transfer chamber 22 in such a way that the products 14 can be transferred into the latter. The space formed in the container 20 around the transfer chamber 22 remains tightly insulated from the interior of the enclosure 12.

As is diagrammatically illustrated in FIG. 1C, the triple door constituted by the interconnected doors C,F and H is then put back into place. The manipulating system carried by the door C is then again actuated from the inside of the contaminated enclosure 12, so as to disengage or decouple the three doors C,F and H from one another and again lock the door H of the transfer chamber 22 on its flange G.

This is followed by the disconnection of the flange D of the transportation container 20 from the flange A of the enclosure 12 and the adaptor E from the adaptor B. During this same movement, the adaptor E is locked onto the flange D.

As illustrated in FIG. 1D, the container 20 can then be separated from the contaminated enclosure 12, which leads to the reestablishment of the connection between the container door F and its adaptor E. The container 20 is then transported to the second enclosure 16, into which must be introduced the transfer chamber 22 containing the products 14.

The second enclosure 16 is also equipped with at least one access system having a flange A', which has a circular opening of the same diameter as the opening formed in the flange A, and a door B'C' normally sealing said circular opening in a tight manner. It should be noted that the door B'C' can be made in one piece, as is diagrammatically illustrated in FIGS. 1E and 1F, or in two pieces as an adaptor and a door, which are then identical to the adaptor B and the door C equipping the access system to the contaminated enclosure 12.

As illustrated in FIG. 1E, the transportation container 20 is engaged on the access system to the enclosure 16, which has the effect of connecting the flange D to the flange A' and connecting the adaptor E to the door B'C'. This movement also disconnects the adaptor E from the flange D.

Consequently and as illustrated in FIG. 1F, the assembly formed by the door B'C' and the door F and the adaptor E can be extracted in the interior of the enclosure 16 by linking means normally maintaining the door B'C' so as to tightly bear on the interior of the flange A'. When this assembly is dismantled, the transfer chamber 22 closed by its door H can be extracted from the transportation container 20 and transferred into the enclosure 16, without any of the contaminated atmosphere in the enclosure 12 being introduced into said enclosure 16.

The assembly formed by the door B'C' associated with the door F and the adaptor E is then put back into place, after an empty transfer chamber has been introduced into the container 20. As a variant, the introduction of an empty transfer chamber into the container 20 can take place from another enclosure especially provided for this purpose. The container 20 is then disconnected from the enclosure 16 and can then be used again for transporting products between the enclosure 12 and the enclosure 16.

A more detailed exemplified description will now be given of a special embodiment of the installation used in the process described hereinbefore with reference to FIGS. 1A to 1F.

Figure 2:
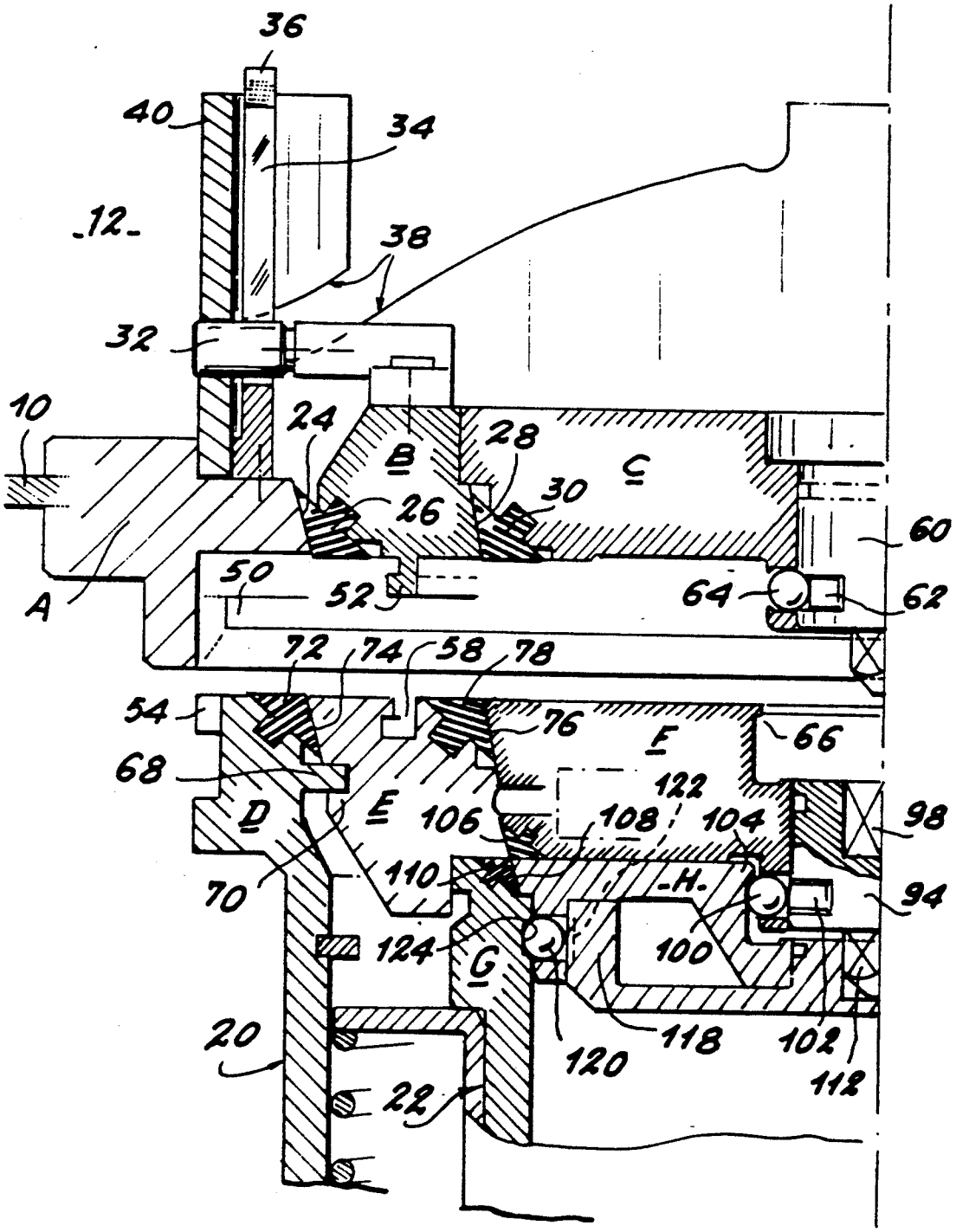
FIG. 2 a longitudinal sectional view showing on a larger scale part of the transfer installation according to the invention just prior to the engagement on an access system to a contaminated enclosure of a transportation container housing a transfer chamber for receiving the products placed within said contaminated enclosure.

FIG. 2 shows that the flange A of the contaminated enclosure 12 internally defines a truncated cone-shaped, circular opening 24, whose diameter increases towards the inside of the enclosure. The adaptor B carries an annular gasket 26 having a triangular cross-section, whereof one of the faces normally tightly bears against the truncated cone-shaped surface of the opening 24 and whereof another face is radially oriented with respect to said opening and turned towards the outside of the enclosure 12. The other face is designed to tightly bear against the face of the adaptor E turned towards the outside of the container 20, in the immediate vicinity of the outer peripheral edge of said adaptor.

The adaptor B also defines a truncated cone-shaped circular opening 28, whose diameter increases towards the inside of the contaminated enclosure 12. One of the faces of an annular gasket 30 having a triangular cross-section and mounted on the door C normally bears tightly against the truncated cone-shaped surface of said opening 28. Another face of the gasket 30, radially oriented and turned towards the outside of the enclosure 12, bears tightly against the surface of the door F turned towards the outside of the container 20, in the immediate vicinity of the peripheral edge of said door, when the container is engaged on the enclosure.

The truncated cone shapes of the surfaces 24 and 28 make it possible to dismantle the adaptor B and the door C towards the inside of the enclosure 12, whilst preventing the reverse movement.

The adaptor B is kept in tight engagement in the opening 24 by disconnectable linking means permitting an opening by pulling out. In the embodiment shown in FIG. 2, the linking means comprise pins 32, (whereof only one is shown), mounted on the face of the adaptor B turned towards the inside of the enclosure 12 and radially oriented. The end of each pin 32 successively traverses a slot 34 formed parallel to the axis of the opening 24 in a part 36 fixed to the inner face of the flange A, and a helically shaped slot 38, formed in a rotary ring 40 also mounted on the flange A.

A rotation of the ring 40 controlled from the inside of the contaminated enclosure 12 leads to the displacement of the pins 32 in the slots 34, as a result of the cooperation of these pins 32 with the helical slots 38. This leads to a pulling out of the adaptor B or the tight engagement of the latter against the opening 24, as a function of the rotation direction of the ring 40.

Figure 3:
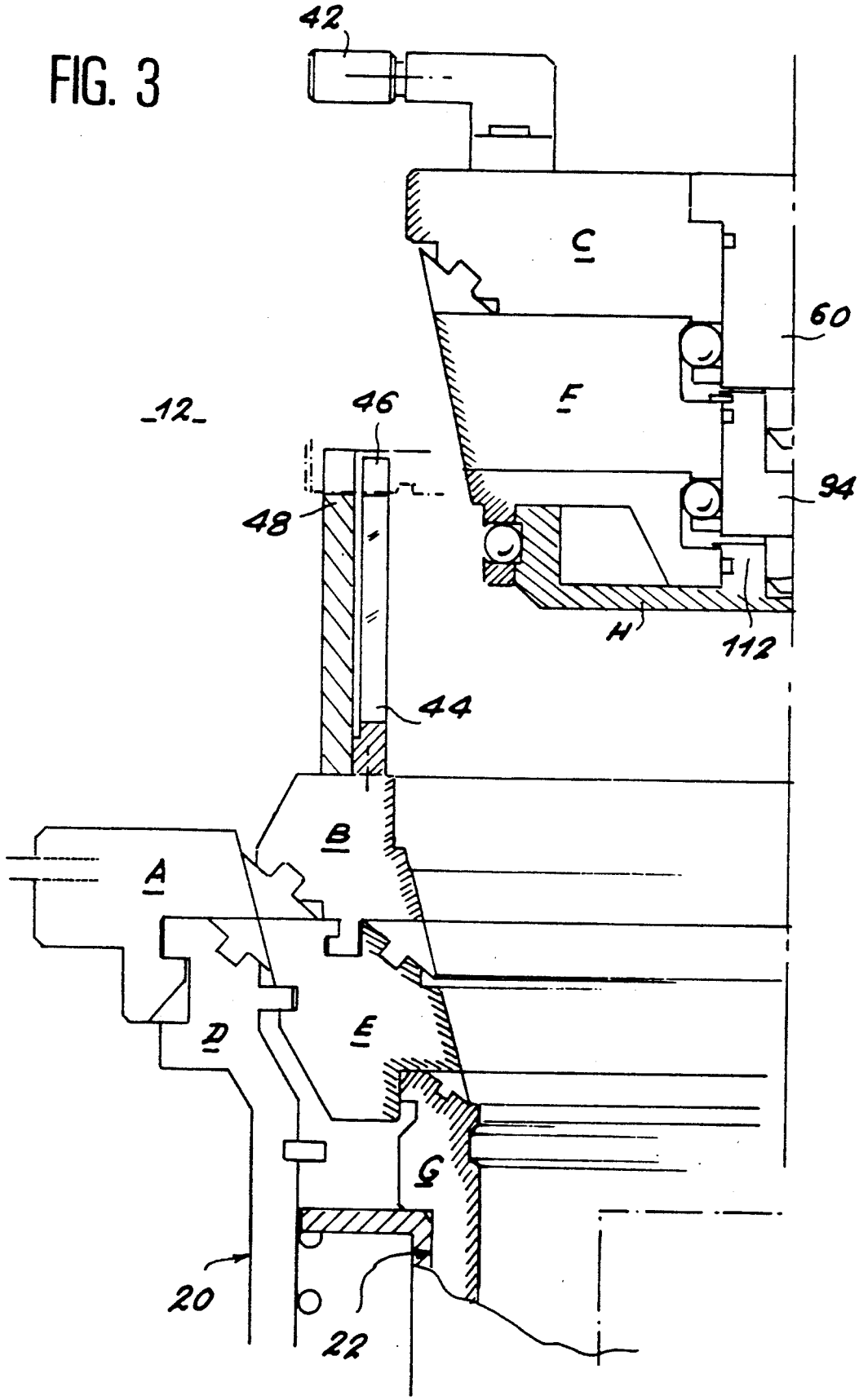
FIG. 3 a sectional view comparable to FIG. 2 illustrating the opening of the triple door prior to the introduction of the products into the transfer chamber, following the engagement of the container on the access system to the contaminated enclosure.

Comparable linking means are provided between the door C and the adaptor B, as illustrated in FIG. 3. These means, identical to those described hereinbefore, comprise pins 42, fixed to the door C and which penetrate slots 44 formed parallel to the axis of the opening 28 in a part 46 fixed to the adaptor B and in not shown, helical slots formed in a rotary ring 48 also supported by the adaptor B.

In order to permit the engagement of the flange D and the adaptor E of the transportation container 20, the flange A and the adaptor B of the contaminated enclosure 12 have bayonet-type engagement means 50,52 respectively on their faces turned towards the outside of the enclosure.

On its face turned towards the outside of the container 20, the flange D has bayonet-type engagement means 54 for cooperating with the bayonet-type engagement means 50 of the flange A, in order to form a bayonet connection system.

In a comparable manner, on its face turned towards the outside of the container 20, the adaptor E has bayonet engagement means 58 for cooperating with the bayonet engagement means 52 of the adaptor B, in order to form another bayonet connection system.

It should be noted that the relative positions between the adaptor B and the flange A on the one hand and between the adaptor E and the flange D on the other, when the two adaptors seal the openings 24 and 74, are such that the connections of the adaptors E and B and the flanges D and A are simultaneously obtained by a rotation of the container 20 about its axis.

Figure 5:
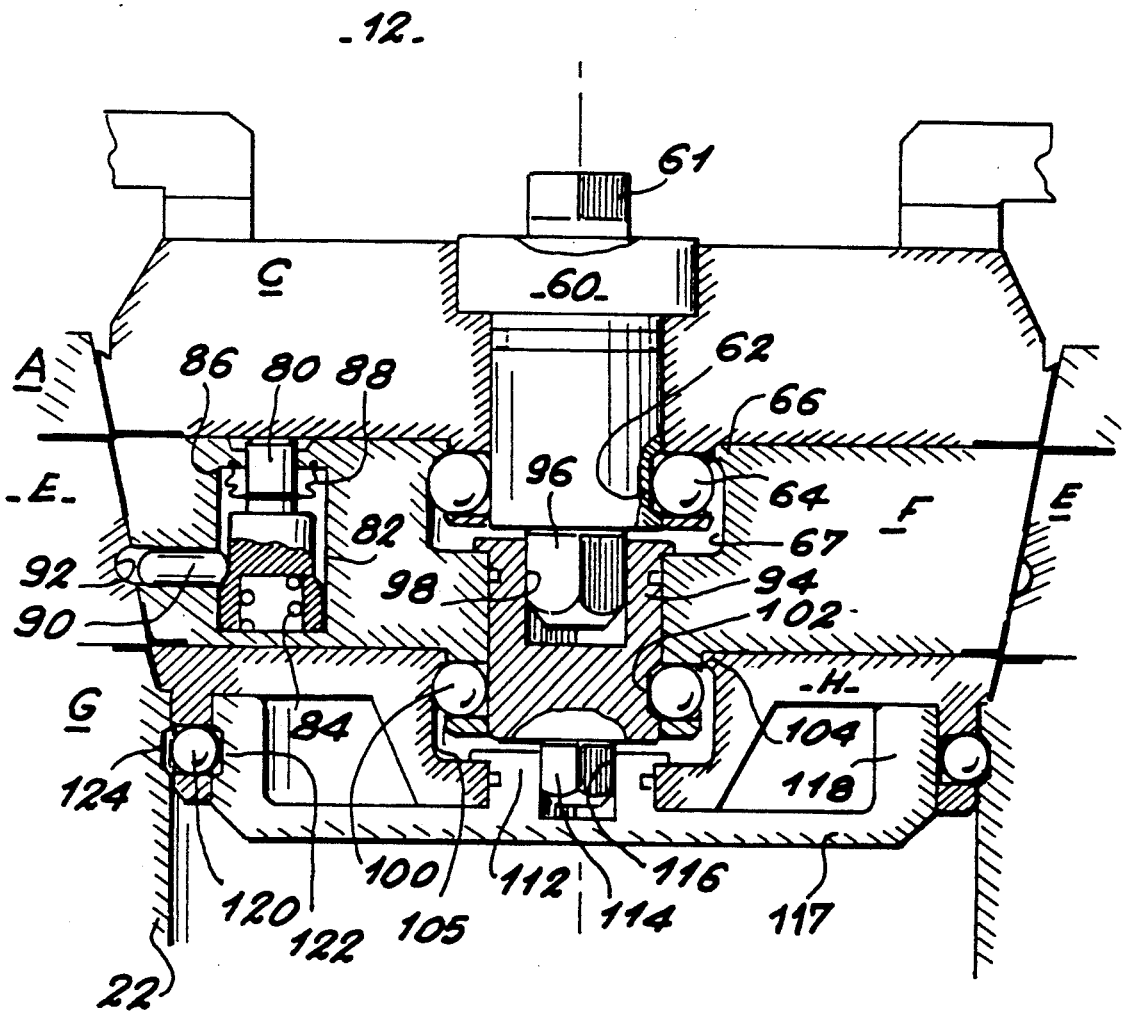
FIG. 5 a diagrammatic longitudinal sectional view illustrating the control mechanism of the engagement means provided between the three doors of the installation and the disconnectable linking means between the plug and the flange of the transfer chamber.

Moreover, the door C is tightly traversed in accordance with its axis by a rotary shaft section 60, which can be rotated from the interior of the contaminated enclosure 12 by manipulating means such as a handwheel or a lever (not shown) engaging on a manipulating square 61 (FIG. 5).

As is illustrated in greater detail in FIG. 5, the rotation of the shaft section 60 controls the putting into operation of a locking ball connection system 64 between the doors C and F. For this purpose, the shaft section 60 has at least one circular arc recess 62, whose bottom constitutes a cam surface permitting, as a function of the angular position of the shaft section 60, either to completely cancel out the locking ball 64 in a disconnection position of the doors C and F, or force them towards the outside into a connection position of the doors. Each of the balls 64 is located in a circular hole radially traversing a tubular extension of the door C, formed around the section 60 on the exterior of the enclosure 12. When they occupy the connection position of the doors C and F, the locking balls 64 project beyond the outer surface of the aforementioned tubular extension. When these doors C and F are coupled, the locking balls 64 are then positioned behind a collar 66 formed in a bore 67 traversing the door F in accordance with its axis, at the end of the bore turned towards the outside of the transportation container 20. The doors C and F are then interlinked.

FIG. 2 also shows that the connection of the adaptor E to the flange D of the container 20 is normally assured by a bayonet connection comprising bayonet engagement means 68 formed within the flange D and bayonet engagement means 70 formed on the outer peripheral surface of the adaptor E. A relative rotation between the flange D and the adaptor E consequently has the effect of joining these two parts.

This bayonet connection between the flange D and the adaptor E is such that these two parts are automatically disengaged from one another, when the flange D and the adaptor E are respectively engaged on the flange A and on the adaptor B by a rotation of the transportation container 20.

Under these conditions, the adaptor E tightly seals a circular opening 74 formed in the flange D, said opening 74 being truncated cone-shaped and having a diameter which decreases towards the interior of the container 20. The opening 74 is formed on one of the faces of an annular gasket 72, which has a triangular cross-section and which is fitted on the flange D. A radial face of the same gasket 72 also tightly bears against the outer surface of the flange A immediately surrounding the opening 24, when the flange D is engaged on the flange A.

It should be noted that the shape of the opening 24 in which is received the adaptor B and the shape of the opening 74 in which is received the adaptor E are such that these two openings form a single truncated cone-shaped surface when the flanges A and D are coupled. The diameter of this truncated cone-shaped surface decreases towards the outside of the enclosure 12, which permits the simultaneous disassembly of the adaptors B and E towards the interior of the enclosure, while preventing their reverse movement.

FIG. 2 also shows that the door F is received in a circular opening 76, whose truncated cone shape extends that of the opening 28 formed in the adaptor B, when the container 20 is engaged on the contaminated enclosure 12. This arrangement permits the simultaneous removal of the doors C and F towards the interior of the enclosure 12, while preventing the reverse movement.

An annular gasket 78 having a triangular cross-section is also mounted on the adaptor E, in such a way that it has a truncated cone-shaped inner face defining the opening 76 and a radial face turned towards the exterior of the container 20 and able to tightly bear against an outer surface of the adaptor B located in the immediate vicinity of the opening 28, when the two adaptors are engaged.

The disconnectable link by which the door F is normally coupled to the door E comprises several identical mechanisms, mounted in the door F and circumferentially distributed about its axis. As illustrated by FIG. 5, each of these mechanisms comprises a plunger 80 slidingly mounted in a blind bore 82 formed in the door F parallel to its axis and issuing onto the face of said door turned towards the outside of the container. A spring 84 bearing on the bottom of the blind bore 82 normally maintains the plunger 80 in a position such that its opposite end projects beyond the outer face of the door F. This position is determined by the bearing of a shoulder formed on the plunger 80 against an abutment surface 86 formed in the bore 82. A sealing bellows 88, whose ends are respectively mounted on the plunger 80 and on the surface 86, ensures the confinement of the interior of the bore 82 with respect to the exterior.

The mechanism illustrated in FIG. 5 is completed by a locking pin 90 slidingly placed in a circular hole radially traversing the door F and linking the bore 82 with the truncated cone-shaped, peripheral surface of said door.

When the plunger 80 is in its projecting position, a larger diameter portion of the plunger faces the locking pin 90, so that the latter is forced radially towards the outside. Its end then projects beyond the truncated cone-shaped, peripheral surface of the door F into an annular groove 92 formed in the internal peripheral surface of the adaptor E, when the door F is located within said adaptor. However, when the plunger 80 is forced into the bore 82 in opposition to the spring 84, which occurs as a result of the bearing of said plunger on the outer face of the door C during the engagement of the container 20 on the enclosure 12 (FIG. 5), the locking pin 90 faces a reduced diameter portion of the plunger 80, so that the locking finger 90 passes into the door F and no longer projects over the truncated cone-shaped, peripheral surface of the door. Therefore the door F is automatically disengaged from the adaptor E during the engagement of the container 20 on the enclosure 12.

As illustrated in FIGS. 2 and 5, the door F of the transportation container 20 is also tightly traversed along its axis by a rotary shaft section 94, whose rotation makes it possible to control, as a function of the direction, the connection or disconnection of the doors F and H. This rotation is obtained with the aid of manipulating means controlling the rotation of the shaft section 60, when said container 20 is engaged on the enclosure 12. Thus, the rotary shaft sections 60 and 94 then cooperate with one another by rotation linking means, e.g. constituted by a part 96 having a polygonal cross-section of the shaft section 60, which projects towards the outside of the enclosure 12 and penetrates a recess 98, which has a complementary cross-section and which is formed on the face of the shaft section 94 turned towards the outside of the container 20.

The locking ball system 100 ensuring the connection and disconnection of the doors F and H is like the system making it possible to connect and disconnect the doors C and F.

More specifically and as illustrated in FIG. 5, the locking balls 100 are slidingly received in circular holes made radially in a tubular extension of the door F projecting towards the inside of the container around the shaft section 94. A circular arc groove 102 formed to the right of each of the holes on the outer surface of the shaft section 94 and whose bottom forms a cam surface makes it possible, as a function of the angular position of the shaft section 94, either to place the balls 100 within the holes, or force them towards the outside. In the latter case, the balls 100 project behind a collar 104 formed in a bore 105 axially traversing the door H in the vicinity of the face of said door turned towards the outside of the transfer chamber 22.

On again referring to FIG. 2, it can be seen that the door F of the transportation container 20 supports an annular gasket 106, which has a triangular cross-section and whereof an outer peripheral face tightly bears on the truncated cone-shaped surface formed by the opening 76 when the door F is placed in the adaptor E. The gasket 106 also has a radial face for tightly bearing against the surface of the door H turned towards the outside of the transfer chamber 22, in the immediate vicinity of the periphery of said door, when the doors F and H are applied to one another.

The flange G of the transfer chamber 22 also defines a circular opening 108, whose truncated cone shape extends that of the openings 28 and 76, so that the joined doors C,F and H can be simultaneously removed towards the inside of the enclosure 12, whereas they cannot move in the opposite direction.

The circular opening 108 is at least partly formed on the inner peripheral face of an annular gasket 110, which has a triangular cross-section and which is mounted on the flange G. This gasket 110 also has a radial surface able to tightly bear against a surface of the adaptor E turned towards the inside of the container 20 and positioned in the immediate vicinity of the circular opening 76, when the flange G is applied to the adaptor E.

As illustrated by FIG. 5, the door H is also tightly traversed along its axis by a rotary shaft section 112, whose rotation makes it possible to control the connection and disconnection of the door H relative to the flange G. This rotation is controlled by the manipulating means located in the contaminated enclosure 12 through rotary shaft sections 60 and 94. For this purpose, between the sections 94 and 112 there are means making it possible to ensure the linking in rotation when the doors F and H are applied to one another. As is shown in exemplified manner in FIG. 5, the means can comprise an extension 114, having a polygonal cross-section, of the shaft section 94 located outside the section and turned towards the interior of the container 20. This extension 114 is received in a recess 116, whose cross-section is complementary to that of the extension 114 and which is formed in the end of the shaft section 112 turned towards the outside of the transfer chamber 22, when the doors F and H are coupled. Within the transfer chamber 22, the shaft section 112 is integral with a disk 117 terminated on its periphery by a ring 118.

The connection between the door H and the flange G is brought about in the same way as the previously described connections between the doors C and F and between the doors F and H. More specifically, the connection or link comprises a locking ball system 120. The balls are received in circular holes formed radially in a tubular portion of the door H projecting towards the inside of the transfer chamber in the flange G. Circular arc grooves 122 formed on the outer surface of the ring 118 and whose bottoms form cam surfaces make it possible, as a function of the angular position of the ring, either to place the balls 120 within their holes, or to make them project in such a way that they penetrate a groove 124 formed in the flange G.

Figure 4:
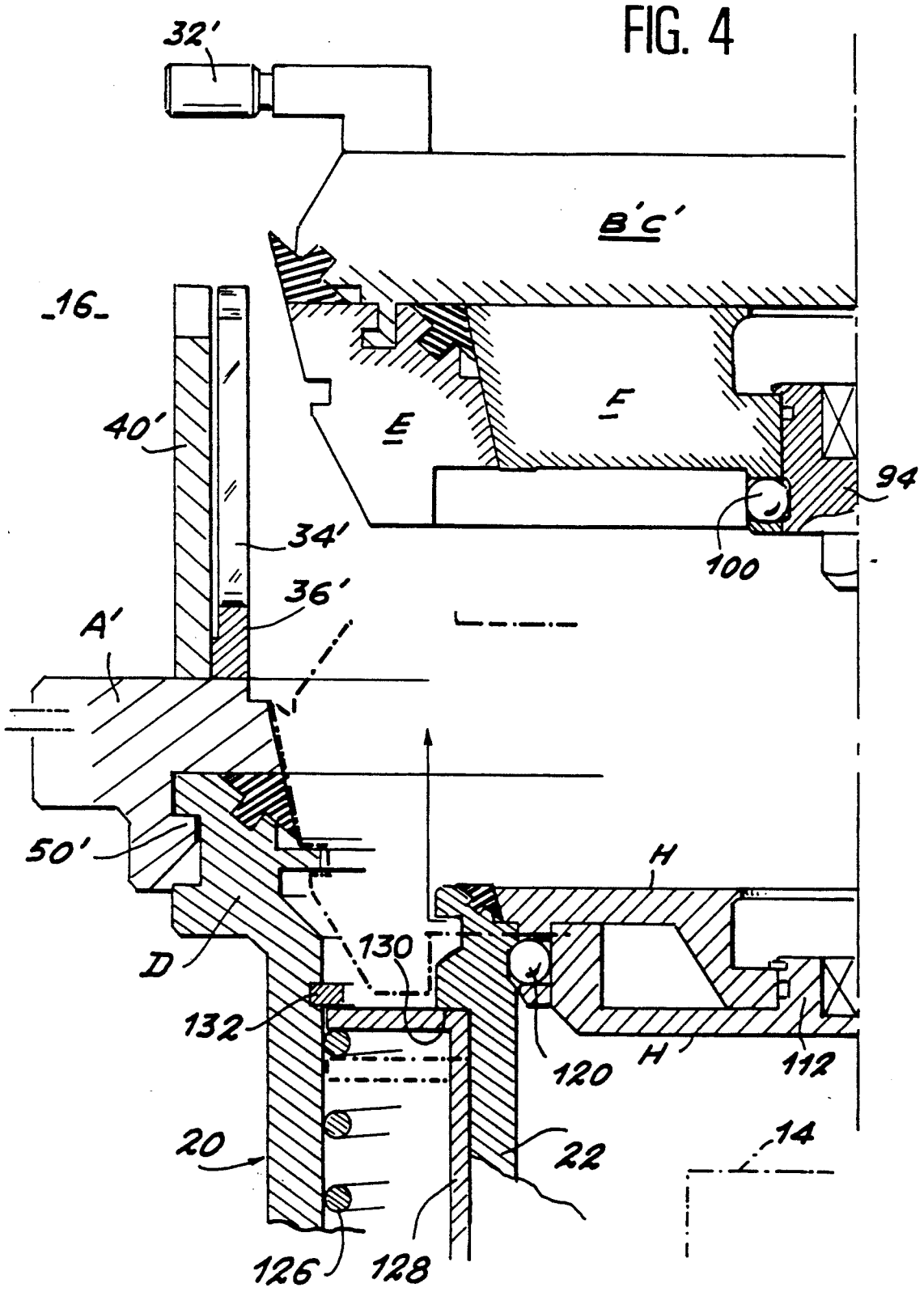
FIG. 4 a sectional view comparable to FIGS. 2 and 3 illustrating the opening of a double door of the installation according to the invention permitting, following the engagement of the transportation container on an access system to a second enclosure, the introduction into the latter of the transfer chamber containing the products.

As illustrated by FIG. 4, these different mechanisms are completed by a system placed within the transportation container 20 making it possible to maintain the flange G of the transfer chamber 22 tightly bearing against the container adaptor E, when the container is closed and contains the transfer chamber.

In the represented embodiment, the system mainly comprises a helical compression spring 126 centered on the axis of the container and located in the immediate vicinity of the cylindrical wall thereof. This compression spring 126 bears by one end on the bottom of the container 20 and by its opposite end on a collar formed on a sliding sleeve 128 located in the annular space surrounding the transfer chamber 22 within the container 20. When the transfer chamber 22 is present in the transportation container 20, the sliding sleeve 128 is normally kept bearing against a shoulder 130 formed on the flange G, so that the latter is normally kept tightly pressed against the container adaptor E.

When the adaptor E is removed, as is shown in continuous line form in FIG. 4, the collar of the sliding sleeve 128 bears against a stop washer 132 mounted in the container 20 in the vicinity of its open end, so that the transfer chamber 22 is not ejected under the action of the spring 126.

As illustrated by FIG. 2, before the container 20 housing the empty transfer chamber 22 is engaged on the contaminated enclosure 12, the adaptor B tightly seals the opening 24 of the flange A and the door C tightly seals the opening 28 of the adaptor B. In addition, the locking balls 64 are in their engaged or embedded position.

Moreover, the parts A, B and C are indexed, in such a way that they are immobilized in rotation with respect to one another. Finally, the shaft section 60 occupies an indexed position in the door C.

Moreover, the bayonet connections 68, 70 between the adaptor E and the flange D is locked, the door F is locked in the adaptor E by the locking pins 90 and the door H is locked in the flange G by the locking balls 120. Moreover, the flange G and the door H of the transfer chamber 22 are tightly pressed respectively against the adaptor E and the door F of the container 20 by the spring 126. However, the locking balls 100 are sufficiently embedded that the doors F and H are not locked together. Moreover, the parts D, G and H are indexed, so that these parts are immobilized in rotation with respect to one another and this also applies with regards to the parts E and F.

When the container 20 is engaged on the contaminated enclosure 12, a rotation of 60° of the container about its axis has the effect of turning by 60° the parts D, G and H with respect to the flange A and by 30° the parts E and F with respect to the parts B and C on the one hand and the flange D on the other. Consequently the rotation of the container has the effect of joining flanges D and A and adaptors E and B, as a result of the bayonet connections 50,54 and 52,58 provided between the parts, followed by the disengagement of the adaptor E from the flange B of the container 20.

At the start of this engagement, the part 96 of the rotary shaft section 60 penetrates the recess 98 of the rotary shaft section 94. This penetration is made possible by not shown, rotation indexing means of the door F in the adaptor E. It should be noted that the shaft sections 60,94 and 112 remain immobilized in rotation with respect to the door C during the rotation of the container 20. However the 30° rotations of the door F about the section 94 and the 60° rotations of the door H about the section 112 resulting from this have no effect on the locking ball links 100 and 120, which respectively remain unlocked and locked.

Moreover, the engagement of the container 20 on the enclosure 12 has the effect of disengaging the door F from the adaptor E by pushing back the plunger 80 in opposition to the spring 84. Thus, there is no longer any connection between the door F and the adaptor E. The locking balls 64 and 100 are then still in their unlocked state and the locking balls 120 in their locked state, as is illustrated to the right in FIG. 5.

From the interior of the contaminated enclosure 12 and using appropriate remote manipulating means, an operator acts on the operating member 61 (FIG. 5) making it possible to rotate the rotary shaft section 60. As a result of the fact that the shaft sections 60,94 and 112 are linked in rotation, this action makes it possible to simultaneously rotate the three sections. More specifically, the operator then carries out a rotation in accordance with an angle such that it has the effect of changing the state of each of the locking ball systems 64,100 and 120, the angle, for example, being 30°. Consequently, when the action of the operator is ended, the doors C and F are interconnected by locking balls 64 and the doors F and H are also interconnected by balls 100. However, the connection between the door H and the flange G of the transfer chamber 22 is eliminated. The corresponding position of the locking balls 64,100 and 120 is illustrated to the left in FIG. 5.

Still acting remotely from the interior of the contaminated enclosure 12, the operator then rotates the ring 48 in order to pull out the door C and the doors F and H which are connected thereto, as illustrated in FIG. 3. When this pulling out is finished, the position of FIG. 1B is obtained, which makes it possible to introduce the products 14 into the transfer chamber 22.

Reverse operations to those described hereinbefore make it possible to simultaneously close again the doors C,F and H, followed by the disengagement of the container 20 housing the transfer chamber 22 containing the products 14 from the confinement enclosure 12, so that the conditions according to FIG. 1D are again obtained.

It should be noted that during these different operations, the contaminated atmosphere present in the enclosure 12 has penetrated the transfer chamber 22, but that the atmosphere present around the chamber within the transportation container 20 has at no time been in contact with the contaminated atmosphere.

As illustrated by FIG. 4, the container 20 can then be engaged on the access system to the second enclosure 16. This access system will not be described in detail, because it essentially has the same characteristics as the access system to the contaminated enclosure 12, although it can be slightly simpler.

Thus, the flange A' of the access system to the second enclosure 16 is completely identical to the flange A of the contaminated enclosure, both as regards the dimensional characteristics and as regards the different systems mounted on said flange. These systems comprise a bayonet system 50' identical to the system 50 of the flange A on the outer face of the flange A' and on the inner face of said flange, a tubular part 36' having slots 34' parallel to the axis of the flange A, as well as a rotary manipulating ring 40' having not shown helical slots.

The simplification of the access system to the second enclosure 16 relates to the door B'C', which can be made in one piece instead of being constituted by an adaptor B and a door C, as in the access system to the contaminated enclosure 12. This door B'C' has the same dimensions as the assembly formed by the door C and the adaptor B of the access system to the enclosure 12. Moreover, the door B'C' is also equipped with pins 32' able to penetrate slots 34' and the helical slots of the ring 40', so as to fix the door B'C' to the flange A' or pull it therefrom. The door B'C' is also equipped with bayonet connection means 52', identical to the connection means 52 for the adaptor B. Finally, the door B'C' is a conventional door, i.e. there is no rotary shaft system 60, or locking balls 64. Thus, the bayonet connection existing between the door B'C' and the adaptor E simultaneously connects the door F to the door B'C', because the latter prevents the escape to the outside of the door F.

When the container 20 is engaged on the second enclosure 16, the rotation of the container 20 has the effect of joining the flanges D and A' and disengaging the adaptor E and with it the door F from the door B'C'. Furthermore, the end of this rotation leads to the disengagement of the adaptor E from the flange D of the container 20.

In view of the fact that the ball locking system 100 is then unlocked and that the ball locking system 120 is locked, when the operator acts from the interior of the enclosure 16 using remote control means for the purpose of rotating the ring 40', he pulls away the door B'C' within the enclosure 16 and at the same time the adaptor E and the door F connected to the door B'C'. Under these conditions illustrated in FIG. 4, the transfer chamber 22 containing the products 14 can be transferred into the enclosure 16, without any contamination being introduced into the latter.

The double door constituted by the door B'C', the adaptor E and the door F is then put back into place and then the transportation container 20 is disconnected from the enclosure 16. As stated hereinbefore, an empty transfer chamber can be reintroduced into the container 20 either from the enclosure 16, or from another enclosure, in order to permit the transfer of other products into the container without contaminating the enclosure 16.

Obviously, the invention is not limited to the embodiment described in exemplified manner hereinbefore and covers all variants thereof. Thus, it is readily apparent that the engagement means making it possible to interconnect the different flanges, adaptors and doors, as well as the linking means by which the adaptors can be locked in the flanges and the doors locked in the adaptors can differ from the means described hereinbefore.

Moreover, the door B'C' of the second enclosure 16 can in certain cases be replaced by an adaptor B'-door C' assembly identical to the adaptor B-door C assembly. In this case, the door C' must be traversed by a rotary shaft section like the section 60, making it possible to connect the doors C' and F by a locking ball system identical to that having the balls 64. The rotation exerted on the coupled shaft sections following the engagement of the container on the enclosure 16 must be such that it then controls the attachment of the doors C' and F, without leading to any change of state of the locking ball systems 100 and 120. This can be obtained by giving the circular arc grooves of the two latter systems an angular length greater (e.g. double) that of the grooves of the locking ball system provided between the doors C' and F.

We claim:

1. Installation for transferring products from a contaminated enclosure into a second enclosure without contaminating the latter, characterized in that it comprises:

an access system to the contaminated enclosure, comprising a first flange, a first adaptor and a first door, first disconnectable linking means for maintaining the first adaptor in tight manner in an opening of the first flange, second disconnectable linking means for maintaining the first door in tight manner in an opening of the first adaptor and first engagement means provided on an outer face of the first flange, the first adaptor and the first door;

an access system to the second enclosure comprising a second flange and a second door, third disconnectable linking means for maintaining the second door in tight manner in an opening of the second flange and second engagement means provided on an outer face of the second flange and the second door;

a transportation container;

a transfer chamber which can be received in the transportation container;

an access system to the transportation container comprising a third flange, a second adaptor and a third door, fourth disconnectable linking means for maintaining the second adaptor in tight manner in an opening of the third flange, fifth disconnectable linking means for maintaining the third door in an opening of the second adaptor, third engagement means provided on an outer face of the third flange, the second adaptor and the third door and able to cooperate with the first engagement means and with the second engagement means and fourth engagement means provided on an inner face of the third door;

an access system to the transfer chamber comprising a fourth flange and a fourth door, a sixth disconnectable linking means for maintaining the fourth door in tight manner in an opening of the fourth flange and fifth engagement means provided on an outer face of the fourth door and able to cooperate with the fourth engagement means; and application means for maintaining an outer face of the fourth flange tightly bearing against an inner face of the second adaptor, when the transfer chamber is placed in the transportation chamber.

2. Installation according to claim 1, wherein the third engagement means provided on the third flange and on the second adaptor form first bayonet connection systems with the first engagement means provided on the first flange and on the first adaptor and with the second engagement means provided on the second flange and on the second door, fourth disconnectable linking means form a second bayonet connection system, whilst a rotation of the transportation container connecting the first bayonet connection systems also has the effect of disconnecting the second bayonet connection system.

3. Installation according to claim 1, wherein the fifth disconnectable linking means comprise at least one locking pin radially mobile in the third door between a normal locking position obtained under the action of elastic means, in which the locking pin projects into a recess of the second adaptor, and an unlocked position obtained during the bearing of the third door on the first and second doors.

4. Installation according to claim 1, wherein the first engagement means provided on the first door comprise a first locking ball system controlled by a first rotary shaft section traversing the first door in a tight manner and whereof the locking balls are able to penetrate behind a collar of the third door, forming the third engagement means, the fourth engagement means comprise a second locking ball system controlled by a second rotary shaft section traversing the third door in a tight manner and whereof the locking balls are able to penetrate behind a collar of the fourth door, forming the fifth engagement means, the sixth disconnectable linking means comprise a third locking ball system fitted in the fourth door, controlled by a third rotary shaft section traversing the fourth door in a tight manner and whereof the locking balls are able to penetrate a groove of the fourth flange, said first, second and third rotary shaft sections being able to cooperate by rotation linking means when the doors which support them are coupled.

5. Installation according to claim 1, wherein the first, second and third disconnectable linking means comprise pull-out means accessible from the interior of the enclosures.

6. Installation according to claim 1, wherein the application means comprise second elastic means fitted in the transportation container and on which bears the transfer chamber when it is placed in said container.

* * * * *